US011081095B2

(12) United States Patent
Khelif et al.

(10) Patent No.: US 11,081,095 B2
(45) Date of Patent: Aug. 3, 2021

(54) ABSORBENT ACOUSTIC METAMATERIAL

(71) Applicants: UNIVERSITÉ DE FRANCHE-COMTÉ, Besançon (FR); CENTRE NATIONAL DE LA RECHERCHE SCIENTIFIQUE, Paris (FR)

(72) Inventors: Abdelkrim Khelif, École Valentin (FR); Mahmoud Addouche, Besançon (FR); Aliyasin El Ayouch, Besançon (FR)

(73) Assignees: UNIVERSITÉ DE FRANCHE-COMTÉ, Besançon (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 552 days.

(21) Appl. No.: 15/781,394

(22) PCT Filed: Dec. 2, 2016

(86) PCT No.: PCT/FR2016/053190
§ 371 (c)(1),
(2) Date: Jun. 4, 2018

(87) PCT Pub. No.: WO2017/093693
PCT Pub. Date: Jun. 8, 2017

(65) Prior Publication Data

US 2018/0357994 A1 Dec. 13, 2018

(30) Foreign Application Priority Data

Dec. 2, 2015 (FR) ..... 1561744

(51) Int. Cl.
*G10K 11/172* (2006.01)
*G10K 11/04* (2006.01)
*G10K 11/168* (2006.01)

(52) U.S. Cl.
CPC ..... *G10K 11/172* (2013.01); *G10K 11/04* (2013.01); *G10K 11/168* (2013.01)

(58) Field of Classification Search
CPC ..... G10K 11/172; G10K 11/168; G10K 11/04
See application file for complete search history.

(56) References Cited

U.S. PATENT DOCUMENTS 8,789,652 B2 * 7/2014 Swallowe ..... G10K 11/172 181/293
9,179,220 B2 * 11/2015 Morris ..... G10K 9/20
(Continued)

FOREIGN PATENT DOCUMENTS

EP 1031671 A2 8/2000
EP 2827440 A1 1/2015
WO WO-2019021483 A1 * 1/2019 ..... G10K 11/168

OTHER PUBLICATIONS

Qi, L., et al., "Interference-induced angle-independent acoustical transparency," J. Appl. Phys. 2014;116(23)134506-1-234506-6.
(Continued)

*Primary Examiner* — Forrest M Phillips
(74) *Attorney, Agent, or Firm* — Kenealy Vaidya LLP

(57) ABSTRACT

Some embodiments are directed to an elementary acoustic metamaterial cell, including a body made of solid material and at least one resonator defining a groove of width l and depth p, the groove being open on the surface of the body, wherein the depth p is set by a resonant frequency (f) of the cell according to a relationship x, c being the speed of sound in air and the width l is set by an energy density confined in the cell according to a logarithmic relationship $E_{max}$ αlog (l) determined experimentally, the groove having an acoustic
(Continued)

absorption controlled by a ratio between the depth p and the width l of the groove. Some embodiments are also directed to an acoustic screen including such an elementary cell.

19 Claims, 8 Drawing Sheets

(56) References Cited

U.S. PATENT DOCUMENTS

| | | | | |
|---|---|---|---|---|
| 9,330,651 | B1 * | 5/2016 | Wang | G10K 11/172 |
| 2005/0258000 | A1 * | 11/2005 | Yano | F01N 1/24 181/210 |
| 2011/0000741 | A1 * | 1/2011 | Berker | F24F 13/0263 181/296 |
| 2011/0100748 | A1 * | 5/2011 | Nonogi | B32B 23/10 181/291 |

OTHER PUBLICATIONS

Zhang, S., et al., "Broadband Acoustic Cloak for Ultrasound Waves," Phys. Rev. Let. 2011;106(2):024301-01-024301-4.

Stenger, N., et al., "Experiments on Elastic Cloaking in Thin Plates," Phys. Rev. Let. 2012;108(1):014301-1-014301-5.

Cheng, Y., et al., "Ultra-sparse metasurface for high reflection of low-frequency sound based on artificial Mie resonances," Nature Materials 201514(10):1013-1019.

International Search Report and Written Opinion for PCT Patent App No. PCT/FR2016/053190 (dated Mar. 16, 2017) with English language translation of the ISR.

* cited by examiner

ABSORBENT ACOUSTIC METAMATERIAL

CROSS REFERENCE TO RELATED APPLICATIONS

This application is a national phase filing under 35 C.F.R. § 371 of and claims priority to PCT Patent Application No. PCT/FR2016/053190, filed on Dec. 2, 2016, which claims the priority benefit under 35 U.S.C. § 119 of French Patent Application No. 1561744, filed on Dec. 2, 2015, the contents of each of which are hereby incorporated in their entireties by reference.

BACKGROUND

Some embodiments relate to acoustic insulators, and in particular to an elementary cell of an acoustic metamaterial, and to an acoustic screen including such a cell.

In everyday life, sound pollution, whether it originates for example from the outside environment (proximity to a road or flight path) or indeed from an inside environment (noise generated by household appliances), creates stress, which decreases quality of life.

Sound pollution is also encountered in the construction industry and in various industrial fields.

To get peace and quiet, it is often necessary or helpful to acoustically insulate the source of noise. To do this, solutions allowing the propagation of sound waves to be attenuated exist. However, related art acoustic insulators are based on the use of intrinsic material properties to achieve absorption or reflection of sound waves. The materials in the related art used to this end are typically porous materials, such as metal foams or polymers, cotton-, glass- or rockwool, cork or agglomerated wood fibers.

SUMMARY

One problem raised by the use of such materials resides in the fact that the choice of the material to be used is dictated by the intrinsic properties of the material, this limiting the number of materials that may be used for a given application. In addition, basing the choice of material on the intrinsic properties thereof also limits the frequency response range of the material and the manufacturing techniques.

Furthermore, the acoustic panels manufactured from such materials are heavy and bulky, in particular those used for the low frequencies.

Some embodiments address or solve the problems of the related art acoustic insulators. In particular, some embodiments provide an effective acoustic insulation solution that allows flexibility to be obtained in the choice of material and the frequency range.

Some embodiments decrease the size and weight of acoustic panels.

To this end, some embodiments are directed to an elementary cell of acoustic metamaterial, including:

a body made of solid material; and at least one resonator taking the form of a groove of width l and of depth p, the groove opening onto the surface of the body made of solid material.

The groove that opens onto the surface of the body made of solid material forms a resonant cavity that allows a high degree of spatial confinement of acoustic energy to be obtained. This confinement therefore allows a good absorption of sound waves to be achieved. It also allows the reflection and transmission of sound waves to be decreased.

Such effects are obtained independently of the nature of the solid material, by structuring the surface of the solid material so as to produce one or more resonant cavities. Thus, the nature of the material is irrelevant.

In other words, even if a solid material the intrinsic acoustic absorption properties of which are not excellent is used, the fact that the material is structured so as to form a metamaterial including one or more cavities that open onto the surface allows the acoustic absorption achieved with this material to be considerably improved.

Thus, various solid materials may be used, for example: wood, glass, metals and polymers. This therefore allows a large margin for maneuver as regards the employed manufacturing techniques.

Furthermore, the flexibility in the choice of material allows the weight of these acoustics screens to be significantly decreased.

The elementary cell according to some embodiments may be used for a wide range of frequencies, ranging from 100 Hz to 10 kHz, this corresponding to wavelengths of between 3.5 meters and 3.5 centimeters, respectively.

The length $p=p_{eff}$ of the cavity is also the depth of the groove defining the cavity.

In addition, effective length (designated by $p_{eff}$) is spoken of because the cavity may optionally be filled.

The resonant frequency is related to the effective length $p_{eff}$ of the cavity by the expression $$f = \frac{c}{4p_{eff}},$$

c being the speed of sound in air.

The applicants have, moreover, observed that the width "l" of the aperture of the cavities plays a key role in the dissipation of acoustic energy. The width l corresponds to the distance between the walls of the groove.

More particularly, the achieved enhanced or maximum energy density, calculated as the sum of kinetic and potential energy, varies logarithmically as a function of aperture width $E_{max} \propto \log(t)$.

Thus, the energy density confined in the cavity is controlled by the cavity width.

FIG. 9 illustrates the effect of the width l on the variation in the enhanced or maximum energy density in a cavity the effective length of which defines a resonant frequency of 1 kHz.

Thus, as the sound absorption level is related to the confined energy density such that when one increases the other also increases, the sound absorption level may be controlled through the ratio $$\frac{\lambda}{l}$$

between the wavelength and the width of the grooves; in other words, as the frequency is related to the wavelength by the relationship $f=c/\lambda$ and as $$f = \frac{c}{4p_{eff}},$$

the sound absorption level may be controlled via the ratio between the effective depth of the groove and its width. This ratio may range from a few tens to a few hundred.

Advantageously, the groove is cylindrical, polygonal or rectilinear. This flexibility in terms of the geometry of the groove allows the desired pattern to be chosen, for example in order to improve the esthetics of the overall structure.

Advantageously, the groove is discontinuous and takes the form of sectors that are separated by the solid material from which the body is made. This allows the frequency band of absorption to be broadened.

According to some embodiments, the cell body includes a plurality of grooves. This allows the absorption of sound waves to be increased.

Advantageously, the grooves are concentric. This manner of distributing the grooves has the advantage of guaranteeing the spatial uniformity of the absorption of the sound waves, due to the symmetry.

Advantageously, the one or more grooves have a constant width l over the entire depth p of the grooves.

Advantageously, at least two grooves have different widths l and different depths p. This allows the frequency band of absorption to be broadened and the effectiveness of the absorption at each frequency to be controlled. Specifically, the geometric dimensions of the grooves allow both the frequency and the effectiveness of the absorption to be controlled. The depth p determines the absorption frequency of each groove, and the width l determines how effectively it absorbs.

Advantageously, the body made of solid material includes at least one through-notch. Such a notch allows air to flow and promotes heat exchange between two environments separated by the cell or a panel including the cell.

Advantageously, the one or more grooves are folded so as to have only one aperture and a plurality of folds in the interior of the cell.

This technique of folding the space allows the thickness of a cell to be decreased. This decrease in thickness is particularly important if it is desired to obtain absorption at low frequencies without increasing the thickness of the cell. By way of example, the absorption of a sound wave of 1 kHz frequency (of wavelength $\lambda$=35 cm) would require a resonator taking the form of grooves of about $\lambda/4$=9 cm in depth. Using the technique of folding the space, the thickness of the structure, defined by the depth of the groove, may be divided by 10, while keeping the same absorption performance.

Advantageously, at least one groove contains a fluid or polymer. The fluid or polymer may be contained using a thin membrane on the surface of the cell. This allows acoustic absorption to be induced or increased at even lower frequencies, depending on the nature of the fluid, i.e. gas or liquid, or of the polymer.

Advantageously, the cell body is cylindrical, parallelepipedal or pyramidal. This flexibility regarding the overall shape of the cell facilitates design.

Some embodiments relate to an acoustic screen taking the form of a panel including at least one elementary cell of metamaterial according to some embodiments. Such a screen may include only absorbent elementary cells according to some embodiments, but it may also include other acoustic elements, for example reflective acoustic cells.

Advantageously, the acoustic screen includes a multitude of elementary cells according to some embodiments, the cells being arranged so that each cell is able to act on another neighboring cell so as to modify the resonant frequencies. This also allows an interaction that is favorable to the absorption of sound waves to be generated. The interaction between cells allows the absorption spectrum to be broadened and transmission or reflection to be locally increased, thereby allowing a room to be better insulated or noise therefrom to be reduced or suppressed.

The expression "plane of the panel" is understood, in the present patent application, to mean the surface of the panel, which may be flat or curved.

Advantageously, the elementary cells are arranged in the panel periodically. For example, they may be arranged in particular patterns of square, triangular or honeycomb type. These periodic patterns allow the emergence of an attenuation effect due to the arrayed arrangement of the resonant units to be favored.

BRIEF DESCRIPTION OF THE FIGURES

Some embodiments will be better understood on reading the following description of advantageous or preferred non-limiting embodiments, which are given by way of illustrative example, with reference to the drawings, in which.

DETAILED DESCRIPTION OF EXEMPLARY EMBODIMENTS

Figure 1A:
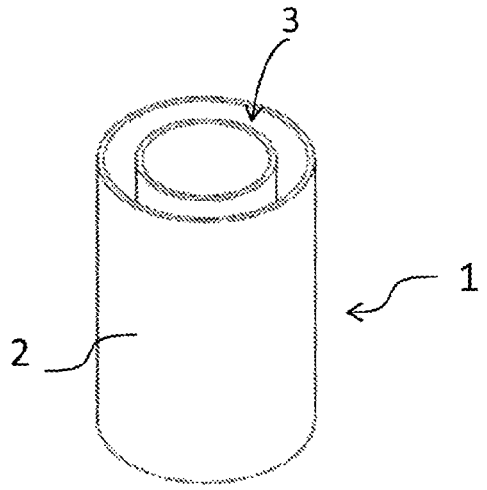
FIGS. 1*a* to 1*c* show a first example embodiment of an elementary cell according to some embodiments, including a single cylindrical groove.
Figure 1C:
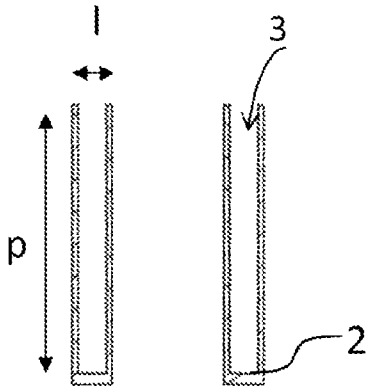
Figure 1B:
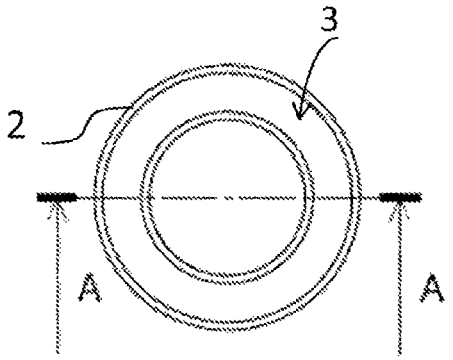

FIG. 1*a* shows an isometric view of an elementary cell 1 of an acoustic metamaterial according to some embodiments. FIGS. 1*b* and 1*c* show a top view and a view of a longitudinal cross section cut along the axis AA of the cell 1, respectively.

The cell 1 includes a cylindrical solid body 2 including a groove 3 that is also cylindrical. The groove 3 is characterized by a depth p and a width l, as shown in FIG. 1*c*. The width l is the distance between the sidewalls of the groove 3.

The presence of the groove, which forms a reasoning cavity, allows a high degree of spatial confinement of acoustic energy to be obtained, this therefore allowing sound waves to be absorbed and reflection and transmission to be decreased.

The depth p defines the resonant frequency and the width l determines the effectiveness of the cell. It is therefore possible to use these two parameters to adjust the frequency at which and how effectively the sound waves are absorbed by the elementary cell 1.

Figure 2A:
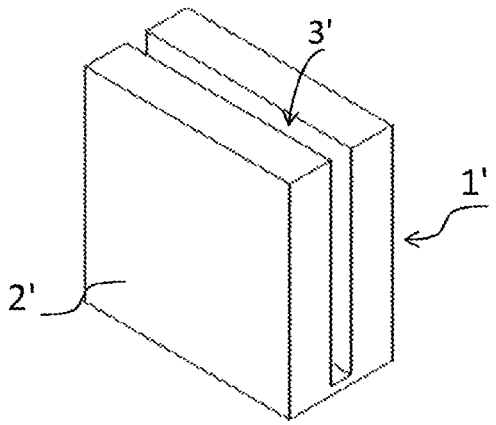
FIGS. 2*a* to 2*c* show a second example embodiment, in which the elementary cell is parallelepipedal and includes a linear groove.
Figure 2C:
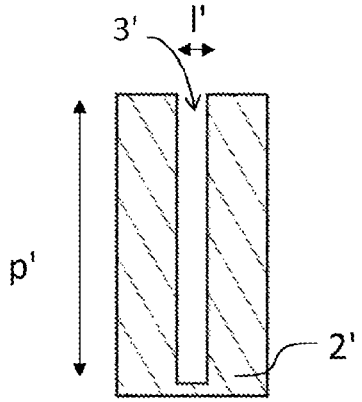
Figure 2B:
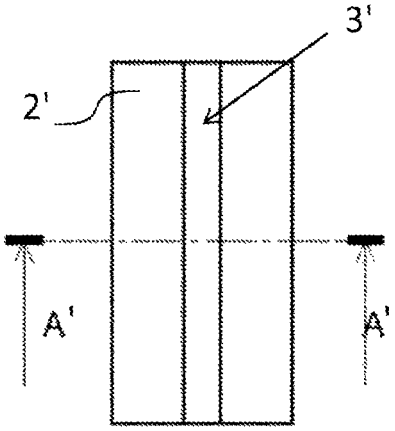

FIG. 2*a* shows an isometric view of a parallelepipedal elementary cell 1'. FIGS. 2*b* and 2*c* show a top view and a view of a longitudinal cross section cut along the axis A'A', of the cell 1', respectively.

The cell 1' includes a parallelepipedal solid body 2' including a linear groove 3'. The groove 3' is characterized by a depth p' and a width l', as in the case of the example of FIG. 1*c*.

Figure 3A:
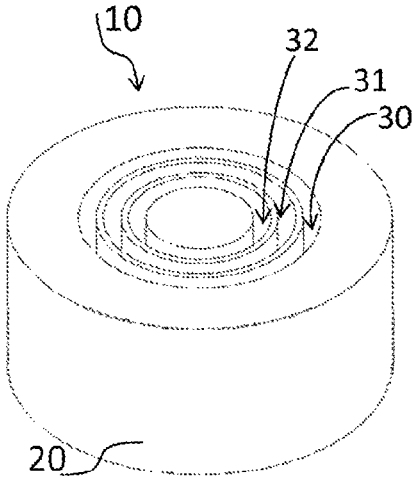
FIGS. 3*a* to 3*d* show an example embodiment, in which the elementary cell is cylindrical and includes three concentric cylindrical grooves.
Figure 3C:
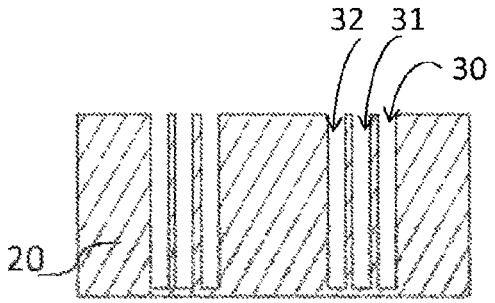
Figure 3B:
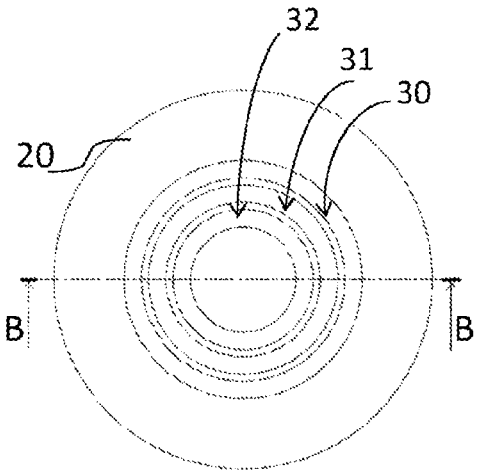

FIG. 3*a* shows an isometric view of an elementary cell 10 including a cylindrical solid body 20 and three concentric cylindrical grooves 30, 31, 32. FIGS. 3*b* and 3*c* show a top view and a view of a longitudinal cross section cut along the axis BB, of the cell 10, respectively.

In this example embodiment, the three grooves 30, 31, 32 have the same depth and the same width as FIG. 3*c* shows.

Figure 3D:
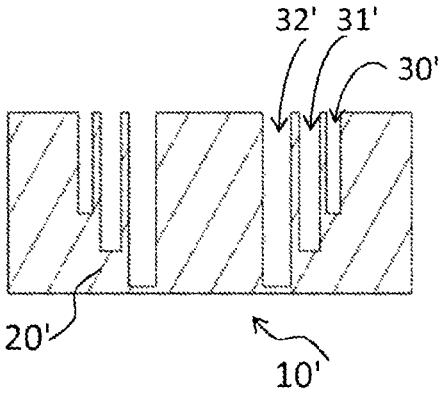

FIG. 3*d* illustrates a view of a cross section that is similar to the view illustrated in FIG. 3*c*, of a cell 10' that includes a cylindrical solid body 20' and three concentric cylindrical grooves 30', 31', 32'. The cell 10' is identical to the cell 10 illustrated in FIGS. 3*a* to 3*c*, except as regards the depths and widths of the grooves 30', 31', 32' which are different for each of the three grooves 31', 32,', 33'. This allows the resonant frequency at which and how effectively each groove absorbs to be made different.

Figure 4A:
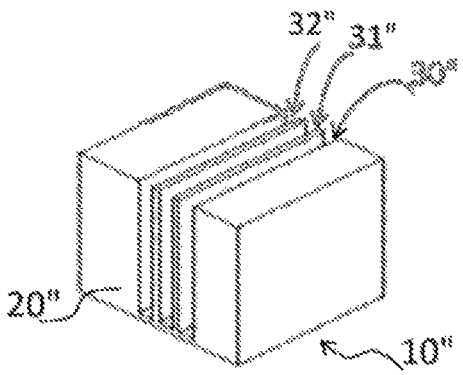
FIGS. 4*a* to 4*c* show an example embodiment, in which the cell is parallelepipedal and includes three linear grooves.
Figure 4C:
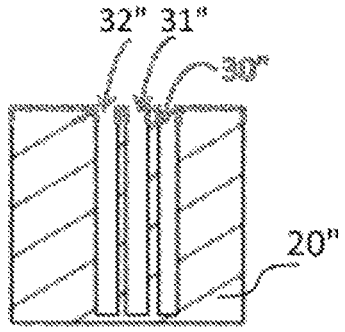
Figure 4B:
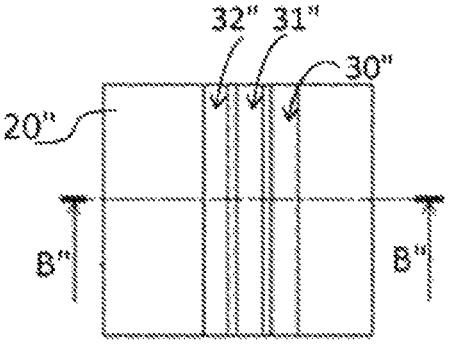

FIG. 4*a* shows an isometric view of a parallelepipedal elementary cell 10". FIGS. 4*b* and 4*c* show a top view and a view of a longitudinal cross section cut along the axis B"B", of the cell 10", respectively.

The cell 10" includes a parallelepipedal solid body 20" including three grooves 30", 31", 32" that have the same depth and the same width as the cross-sectional view of FIG. 4*c* shows.

Figure 5A:
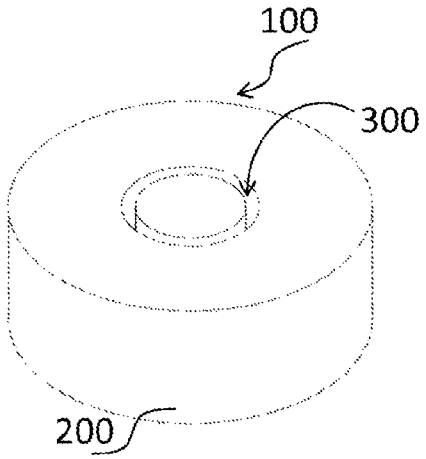
FIGS. 5*a* to 5*c* show an example embodiment, in which the cell is cylindrical and includes a folded cylindrical groove.
Figure 5B:
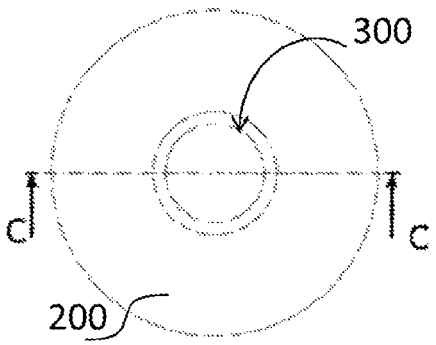
Figure 5C:
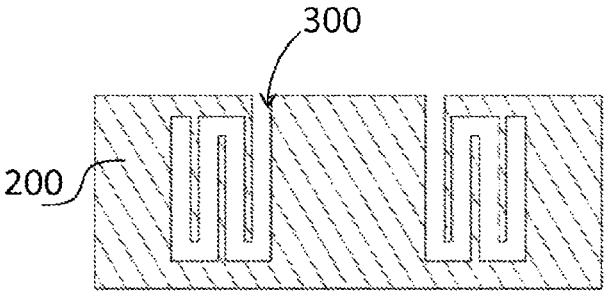

FIG. 5*a* shows an isometric view of an elementary cell 100 according to one example embodiment, in which the cell 100 includes a cylindrical solid body 200 and a folded cylindrical groove 300. FIGS. 5*b* and 5*c* show a top view and a view of a longitudinal cross section cut along the axis CC, of the cell 100, respectively.

FIG. 5*c* illustrates the folds of the groove 300. The folding of the groove 300 allows the thickness of the cell 100 to be considerably decreased, while keeping the effectiveness of absorption of a groove with a depth corresponding to the length of the walls of the groove 300.

Figure 6A:
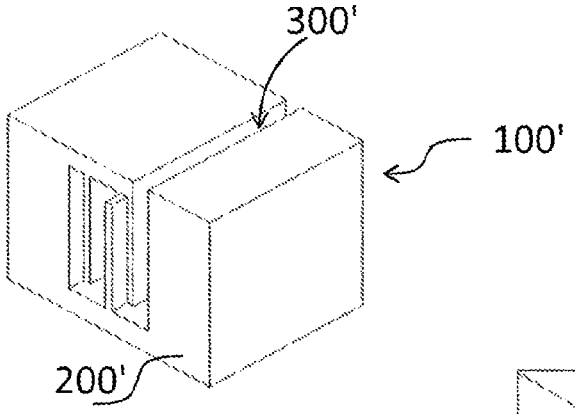
FIGS. 6*a* to 6*c* show an example embodiment, in which the cell is parallelepipedal and includes a folded linear groove.
Figure 6C:
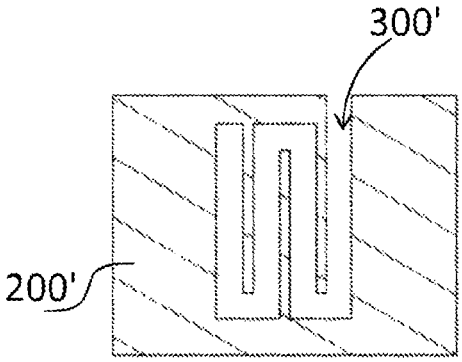
Figure 6B:
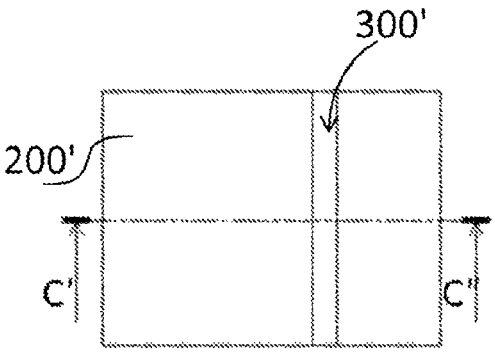

FIG. 6*a* shows an isometric view of a parallelepipedal elementary cell 100' including a parallelepipedal solid body 200' and a folded linear groove 300'. FIGS. 6*b* and 6*c* show a top view and a view of a longitudinal cross section cut along the axis C'C' of the cell 100', respectively.

The parallelepipedal shape has the advantage of allowing the area of an acoustic panel to be better filled.

In FIGS. 2*a*, 4*a* and 6*a* the cells appear to open onto the sides. In fact, the grooves only open onto the surface: such apertures opening onto the sides do not exist and are shown only to allow the shape of the grooves in the interior of the solid body to be better understood.

Figure 7:
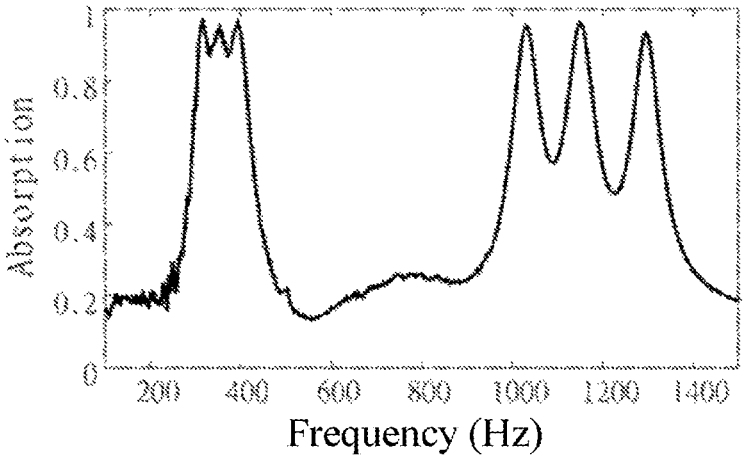
FIG. 7 shows the sound-wave absorption response of an elementary cell according to some embodiments.

FIG. 7 illustrates the absorption response of an elementary cell according to the example embodiment illustrated in the schematics of FIGS. 3*a* to 3*c*, but with a different depth for each groove. This elementary cell has an overall height of 196.5 mm and includes 3 resonant cavities taking the form of concentric cylindrical grooves of a fixed width of 2.7 mm, and of different depths of 160.5 mm, 177 mm and 193.5 mm, respectively.

The cell was manufactured using a Projet SD3500 3D printer, and the properties of the Visijet Crystal resin used were:

Density (g/cm): 1.02 (liquid, at 80°)

Young's modulus: 1463 MPa

Flexural strength: 49 MPa

The presented characterization, which allowed the acoustic properties of the cell to be studied in the audible-frequency range, was obtained by virtue of a standing wave tube equipped with 4 microphones. A Brüel & Kjær 4206-T transmission-loss tube kit was employed.

The diameter of the transmission-loss tube used was 100 mm, this allowing measurements to be carried out in the frequency interval 50-1600 Hz.

A loudspeaker, placed at one end of the tube, generated white noise in the frequency band of interest.

The pressure measurements were carried out using two terminations of different impedance.

FIG. 7 in particular shows the three first resonant frequencies at which an intense absorption occurred, with absorption coefficients reaching as high as 0.97.

For example, the absorption values obtained were:

0.97 at 315 Hz;

0.95 at 353 Hz;

0.96 at 364 Hz;

0.95 at 1031 Hz;

0.96 at 1150 Hz;

0.93 at 1294 Hz.

Thus, with this structure, two bands of intense absorption were obtained:

1st band: centered on 360 Hz, and reaching 0.87 with a relative bandwidth of 44:7%;

2nd band: centered on 1159 Hz, and reaching 0.49 with a relative bandwidth of 44:6%.

Figure 8:
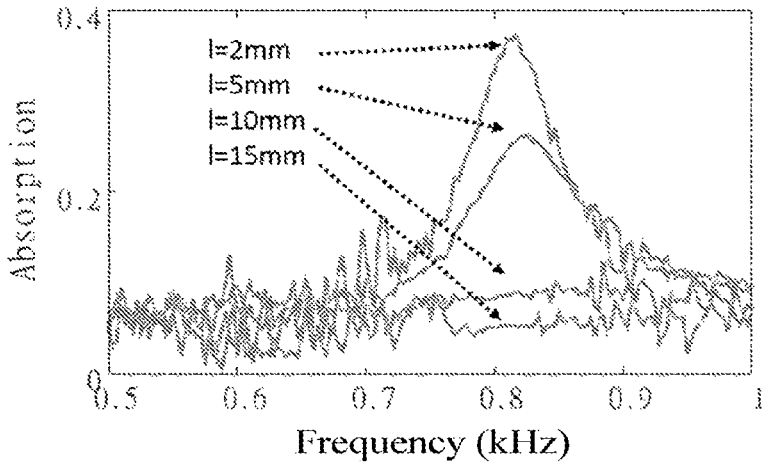
FIG. 8 shows a comparison of absorption curves obtained with elementary cells according to some embodiments the grooves of which have different widths.
Figure 9:
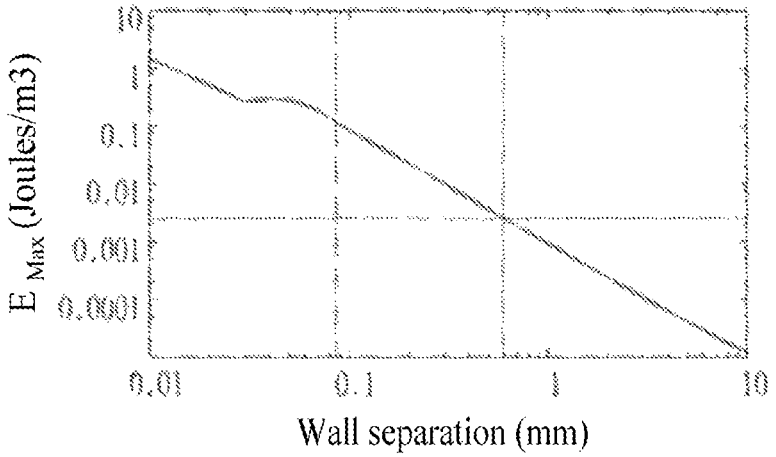
FIG. 9 shows a variation in confined energy density as a function of the width of a groove the effective length of which defines a resonant frequency of 1 kHz, according to some embodiments.

FIG. 8 is a comparison of the absorption curves obtained for different groove widths with four cells according to the example embodiment shown in FIGS. 1*a* to 1*c*.

The cells each had a cylindrical groove of a depth of 100 mm and groove widths of 15 mm, 10 mm, 5 mm and 2 mm, respectively. The radius of each cell was 25 mm.

FIG. 8 shows an increase in absorption as the width of the grooves decreases. The absorption passed respectively from 0.05 to 0.08 to 0.26 then to 0.37 simply by decreasing the dimensional parameter 1.

The invention claimed is:

1. An elementary cell of acoustic metamaterial, comprising:

a body made of solid material; and at least one resonator defining a groove of width l and of depth p, the groove opening only onto one surface of the body, wherein:

the groove is cylindrical, polygonal or rectilinear;

wherein the one or more grooves are folded, in a section orthogonal to said surface, so as to have only one aperture and a plurality of folds in the interior of the cell;

the depth p is determined by a resonant frequency (f) of the cell using a relationship $$f = \frac{c}{4p},$$

c being the speed of sound in air; and the width l is determined by an energy density confined in the cell using an experimentally determined logarithmic relationship $E_{max} \propto \log(l)$, the groove having a sound absorption controlled by a ratio between the depth p and the width l of the groove.

2. The cell as claimed in claim 1, wherein the groove is discontinuous and takes the form of sectors that are separated by the solid material from which the body is made.

3. The cell as claimed in claim 1, wherein the cell body includes a plurality of grooves.

4. The cell as claimed in claim 3, wherein the grooves are concentric.

5. The cell as claimed in claim 1, wherein the one or more grooves have a constant width l over the entire depth p of the groove.

6. The cell as claimed in claim 3, wherein at least two grooves have different widths l and/or different depths p.

7. The cell as claimed in claim 1, wherein the body includes at least one through-notch.

8. The cell as claimed in claim 1, wherein at least one groove contains a fluid or polymer.

9. The cell as claimed in claim 1, wherein the cell body is cylindrical, parallelepipedal or pyramidal.

10. An acoustic screen taking the form of a panel, comprising:

the elementary cell as claimed in claim 1.

11. The acoustic screen as claimed in claim 10, further comprising a multitude of elementary cells that are arranged so that each cell is able to act on another neighboring cell so as to modify the resonant frequencies.

12. The acoustic screen as claimed in claim 11, wherein the elementary cells are arranged in the panel periodically.

13. The cell as claimed in claim 1, wherein the groove is discontinuous and takes the form of sectors that are separated by the solid material from which the body is made.

14. The cell as claimed in claim 1, wherein the cell body includes a plurality of grooves.

15. The cell as claimed in claim 2, wherein the cell body includes a plurality of grooves.

16. The cell as claimed in claim 1, wherein the one or more grooves have a constant width l over the entire depth p of the groove.

17. The cell as claimed in claim 2, wherein the one or more grooves have a constant width l over the entire depth p of the groove.

18. The cell as claimed in claim 3, wherein the one or more grooves have a constant width l over the entire depth p of the groove.

19. A method for determining the depth p and the width l of a cell according to claim 1, wherein:

the depth p is determined by a resonant frequency (f) of the cell according to a relation:

$$f = \frac{c}{4p},$$

c being the speed of sound in air, and in that the width l is determined by an energy density confined in said cell according to an experimentally determined logarithmic relation:

$E_{max} \propto \log(l)$.

* * * * *